US009318125B2

(12) United States Patent
Chatlani

(10) Patent No.: US 9,318,125 B2
(45) Date of Patent: Apr. 19, 2016

(54) NOISE REDUCTION DEVICES AND NOISE REDUCTION METHODS

(71) Applicant: INTEL MOBILE COMMUNICATIONS GMBH, Neubiberg (DE)

(72) Inventor: Navin Chatlani, Maraval (TT)

(73) Assignee: INTEL DEUTSCHLAND GMBH, Neubiberg (DE)

( * ) Notice: Subject to any disclaimer, the term of this patent is extended or adjusted under 35 U.S.C. 154(b) by 443 days.

(21) Appl. No.: 13/741,497

(22) Filed: Jan. 15, 2013

(65) Prior Publication Data

US 2014/0200881 A1 Jul. 17, 2014

(51) Int. Cl.
*G10L 21/00* (2013.01)
*G10L 21/0264* (2013.01)
*G10L 21/0232* (2013.01)

(52) U.S. Cl.
CPC ..... *G10L 21/0264* (2013.01); *G10L 21/0232* (2013.01)

(58) Field of Classification Search
USPC ..... 704/205–208, 226–228, 233
See application file for complete search history.

(56) References Cited

U.S. PATENT DOCUMENTS 6,757,395 B1 * 6/2004 Fang ..... G10L 21/0208 381/94.3
7,369,990 B2 * 5/2008 Nemer ..... G10L 21/0208 379/392.01
7,711,557 B2 * 5/2010 Ozawa ..... 704/226
8,244,523 B1 * 8/2012 Murphy ..... 704/205
8,606,572 B2 * 12/2013 Zhu et al. ..... 704/233
2004/0064307 A1 * 4/2004 Scalart ..... G10L 21/0208 704/205
2005/0058301 A1 * 3/2005 Brown ..... 381/94.2
2006/0074646 A1 * 4/2006 Alves ..... G10L 21/0208 704/226
2006/0224382 A1 * 10/2006 Taneda ..... 704/233
2007/0150261 A1 * 6/2007 Ozawa ..... G10L 21/01 704/200.1
2011/0211711 A1 * 9/2011 Inoue ..... G10L 21/02 381/94.3
2014/0207433 A1 * 7/2014 Chen ..... A01K 1/031 703/2

OTHER PUBLICATIONS

R. Martin, "Noise Power Spectral Density Estimation Based on Optimal Smoothing and Minimum Statistics", IEEE Transactions on Speech an Audio Processing, vol. 9, No. 5, Jul. 2001, pp. 504-512.
M.C. Buechler, "Algorithms for Sound Classification in Hearing Instruments" Diss. ETH No. 14498, Abstract 2002, pp. 1-3.
M. Marzinzik et al., "Speech Pause Detection for Noise Spectrum Estimation by Tracking Power Envelope Dynamics", IEEE Transactions on Speech and Audio Processing, vol. 9, No. 2, Feb. 2002, pp. 109-118.
P. Loizou, "Speech Enhancement: Theory and Practice", Jun. 7, 2007, CRC Press, p. 79.

* cited by examiner

*Primary Examiner* — Leonard Saint Cyr
(74) *Attorney, Agent, or Firm* — Viering, Jentschura & Partner

(57) ABSTRACT

A noise reduction device may be provided. The noise reduction device may include: an input configured to receive an input signal including a representation in a frequency domain of an audio signal, wherein the representation includes a plurality of time frames and a plurality of coefficients for each time frame; a noise detection circuit configured to determine a first indicator being indicative of a bandwidth of a coefficient over at least two time; a noise reduction circuit configured to reduce based on the first indicator a noise component in the audio signal; and an output configured to output an output signal including a representation in the frequency domain of the audio signal with the reduced noise component.

13 Claims, 10 Drawing Sheets

600

602

604

1100

1102

NOISE REDUCTION DEVICES AND NOISE REDUCTION METHODS

TECHNICAL FIELD

Aspects of this disclosure relate generally to noise reduction devices and noise reduction methods.

BACKGROUND

In speech communication in a noisy environment, it may be difficult to understand the communication party. This is especially true for communications taking place in places with heavy traffic, where for example horns of cars may interfere with the spoken words. Thus, there may be a desire for devices and methods that provide for improved communication in places suffering from traffic noise.

SUMMARY

A noise reduction device may include: an input configured to receive an input signal including a representation in a frequency domain of an audio signal, wherein the representation includes a plurality of time frames and a plurality of coefficients for each time frame; a noise detection circuit configured to determine a first indicator being indicative of a bandwidth of a coefficient over at least two time frames; a noise reduction circuit configured to reduce based on the first indicator a noise component in the audio signal; and an output configured to output an output signal including a representation in the frequency domain of the audio signal with the reduced noise component.

A noise reduction method may include: receiving an input signal including a representation in a frequency domain of an audio signal, wherein the representation includes a plurality of time frames and a plurality of coefficients for each time frame; determining a first indicator being indicative of a bandwidth of a coefficient over at least two time frames; reducing based on the first indicator a noise component in the audio signal; and outputting an output signal including a representation in the frequency domain of the audio signal with the reduced noise component.

A noise reduction device may include: an input configured to receive an input signal including a representation in a frequency domain of an audio signal, wherein the representation includes a plurality of time frames and a plurality of coefficients for each time frame; a noise reduction circuit configured to reduce, based on a first indicator being indicative of a bandwidth of a coefficient over at least two time frames, a noise component in the audio signal; and an output configured to output an output signal including a representation in the frequency domain of the audio signal with the reduced noise component.

A noise reduction method may include: receiving an input signal including a representation in a frequency domain of an audio signal, wherein the representation includes a plurality of time frames and a plurality of coefficients for each time frame; reducing, based on a first indicator being indicative of a bandwidth of a coefficient over at least two time frames, a noise component in the audio signal; and outputting an output signal including a representation in the frequency domain of the audio signal with the reduced noise component.

BRIEF DESCRIPTION OF THE DRAWINGS

In the drawings, like reference characters generally refer to the same parts throughout the different views. The drawings are not necessarily to scale, emphasis instead generally being placed upon illustrating the principles of various aspects of this disclosure. In the following description, various aspects of this disclosure are described with reference to the following drawings, in which.

DESCRIPTION

Figure 1:
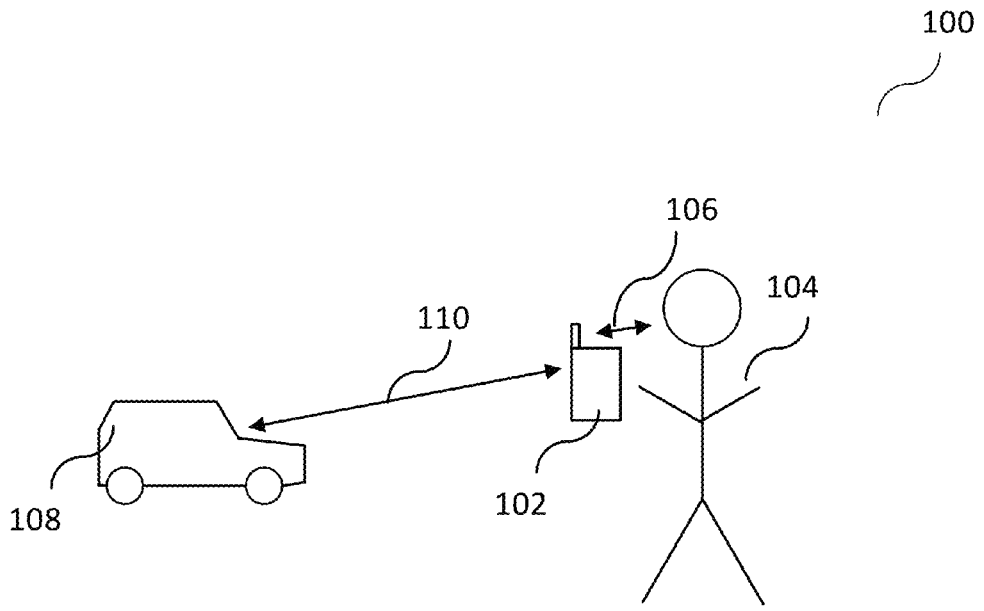
FIG. 1 shows a system in which the noise reduction device may be used.

The following detailed description refers to the accompanying drawings that show, by way of illustration, specific details and aspects of the disclosure in which the invention may be practiced. These aspects of the disclosure are described in sufficient detail to enable those skilled in the art to practice the invention. Other aspects of the disclosure may be utilized and structural, logical, and electrical changes may be made without departing from the scope of the invention. The various aspects of the disclosure are not necessarily mutually exclusive, as some aspects of the disclosure may be combined with one or more other aspects of the disclosure to form new aspects of the disclosure.

The terms "coupling" or "connection" are intended to include a direct "coupling" or direct "connection" as well as an indirect "coupling" or indirect "connection", respectively.

The word "exemplary" or "example" is used herein to mean "serving as an example, instance, or illustration". Any aspect of this disclosure or design described herein as "exemplary" is not necessarily to be construed as preferred or advantageous over other aspect of this disclosure or designs.

A noise reduction device may be provided in a radio communication device. A radio communication device may be an end-user mobile device (MD). A radio communication device may be any kind of radio communication terminal, mobile radio communication device, mobile telephone, personal digital assistant, mobile computer, or any other mobile device configured for communication with another radio communication device, a mobile communication base station (BS) or an access point (AP) and may be also referred to as a User Equipment (UE), a mobile station or an advanced mobile station, for example in accordance with IEEE 802.16m.

The noise reduction device may include a memory which may for example be used in the processing carried out by the noise reduction device. A memory may be a volatile memory, for example a DRAM (Dynamic Random Access Memory) or a non-volatile memory, for example a PROM (Programmable Read Only Memory), an EPROM (Erasable PROM), EEPROM (Electrically Erasable PROM), or a flash memory, for example, a floating gate memory, a charge trapping memory, an MRAM (Magnetoresistive Random Access Memory) or a PCRAM (Phase Change Random Access Memory).

As used herein, a "circuit" may be understood as any kind of a logic implementing entity, which may be special purpose circuitry or a processor executing software stored in a memory, firmware, or any combination thereof. Furthermore, a "circuit" may be a hard-wired logic circuit or a programmable logic circuit such as a programmable processor, for example a microprocessor (for example a Complex Instruction Set Computer (CISC) processor or a Reduced Instruction Set Computer (RISC) processor). A "circuit" may also be a processor executing software, for example any kind of computer program, for example a computer program using a virtual machine code such as for example Java. Any other kind of implementation of the respective functions which will be described in more detail below may also be understood as a "circuit". It may also be understood that any two (or more) of the described circuits may be combined into one circuit.

Description is provided for devices, and description is provided for methods. It will be understood that basic properties of the devices also hold for the methods and vice versa. Therefore, for sake of brevity, duplicate description of such properties may be omitted.

It will be understood that any property described herein for a specific device may also hold for any device described herein. It will be understood that any property described herein for a specific method may also hold for any method described herein.

Devices and methods may be provided for traffic noise reduction.

A Traffic Noise Reduction (TNR) technique for noisy speech captured by a single microphone may be provided for speech enhancement. The provided devices and methods may be particularly effective in noisy environments which contain tonal type noise sources, such as vehicular horns and alarms. With the devices and methods, these vehicular horn sounds may be reduced, and any reference to traffic noise may for example imply this sound disturbance. Devices and methods may be provided for detecting the probability of the presence of these traffic noises which contaminate the target speech signals. These noises may then be attenuated using a devices and methods for estimating the signal and noise power for noise reduction, which may be effective for noise sources with a harmonic spectral structure. The TNR system provided may maintain a balance between the level of noise reduction and speech distortion. Listening tests may confirm the results.

FIG. 1 shows a communication system 100, in which a person 104 may desire to use a radio communication device 102 to speak with another person (not shown). The radio communication device 102 may receive the words spoken by the person 104, like indicated by arrow 106. Besides the words spoken by the person 104, the radio communication device 102 may receive sounds from a car 108, like indicated by arrow 110. The sounds received in the radio communication device 102 from a car may be undesired sounds for the other person, and may deteriorate the quality of the communication. The sounds from the car may include a horn or an alarm, and may be referred to as traffic noise.

Up to now, there is no specific solution to this problem; rather generalized methods to single-channel speech enhancement for any noise source may be used. Single-channel speech enhancement systems in mobile communication devices may be used to reduce the level of noise from noisy speech signals. A common problem in such speech enhancement systems may be the reduction of traffic noise sources, such as vehicular horn sounds, which contaminate the target speech signal. Vehicular horns may be highly non-stationary and they may have a tonal structure. The spectral characteristics of the horn source may vary with its device of origin. Therefore, this may affect the performance of a noise reduction technique which may utilize a comb filter to notch predefined frequencies. In such highly non-stationary environments, the noise power may be desired to be tracked, even during speech activity. Noise estimation techniques which operate in the short-time Fourier transform (STFT) domain may be used, including newer noise estimation systems such as the Minimum Statistics (MS). These MS-based techniques may estimate the noise spectrum based on the observation that the noisy signal power decays to values characteristic of the contaminating noise during speech pauses. The main challenge faced by these techniques may be tracking the noise power during speech segments. This may result in poor estimates during long speech segments with few pauses. This noise estimate may then be used to filter the measured signal to suppress the noise and enhance the output speech.

MS noise estimation may provide small MS windows and tuning of attenuation parameters may result in more noise reduction. However, MS noise estimation does not provide a good balance between noise reduction and low speech distortion for non-stationary noises. Subspace-based noise estimation may provide low-rank approximations for speech in the presence of tonal noises, but may be computationally expensive and not suitable for real-time applications. Amplitude modulation features may provide detection and classification of speech only, noise only and speech in noise situations may be used to control the noise reduction performed; however, it may be sensitive to training and may require a-priori knowledge of the signals being processed. Energy-based noise detection may provide that detection of noise onsets may be used to trigger significant attenuation of the detected components; however this technique may be not robust to low SNR conditions. Pause detection for noise spectrum estimation by tracking power envelope dynamics may provide that pauses may be detected when the interfering noise is present in either the low frequency or high frequency band; however, it may provide low performance in the presence of broadband noise sources. The approaches described in this paragraph are general methods for speech processing and are not specifically targeted to traffic noise reduction.

Figure 2A:
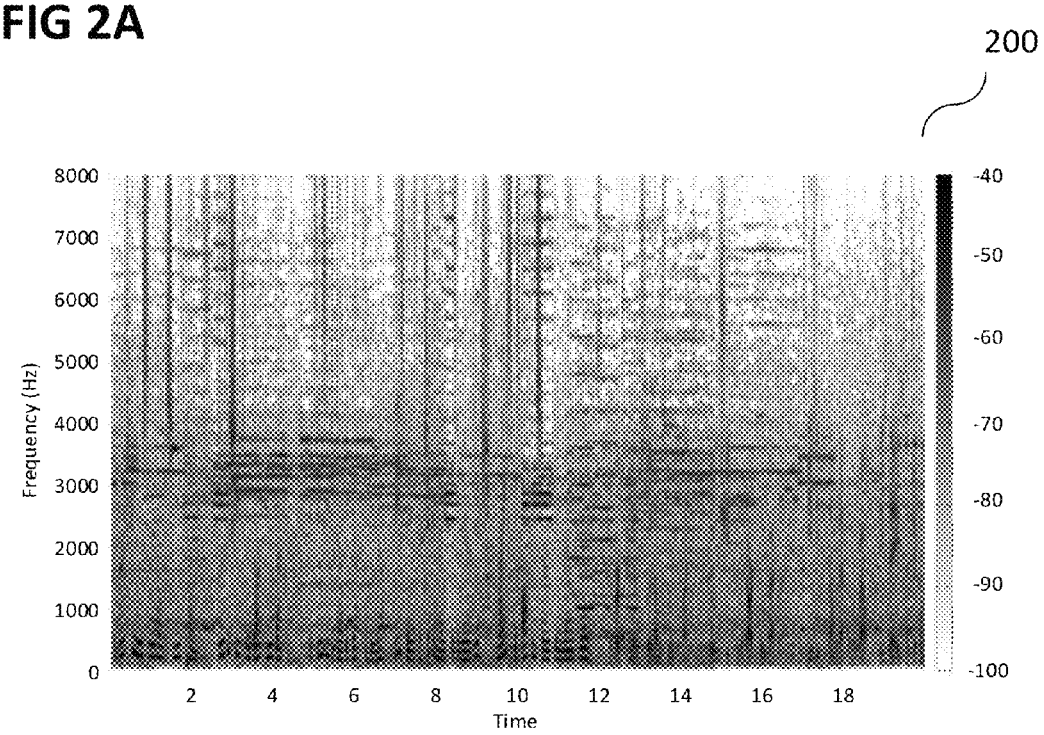
FIG. 2A and FIG. 2B show examples of a minimum statistics based system.
Figure 2B:
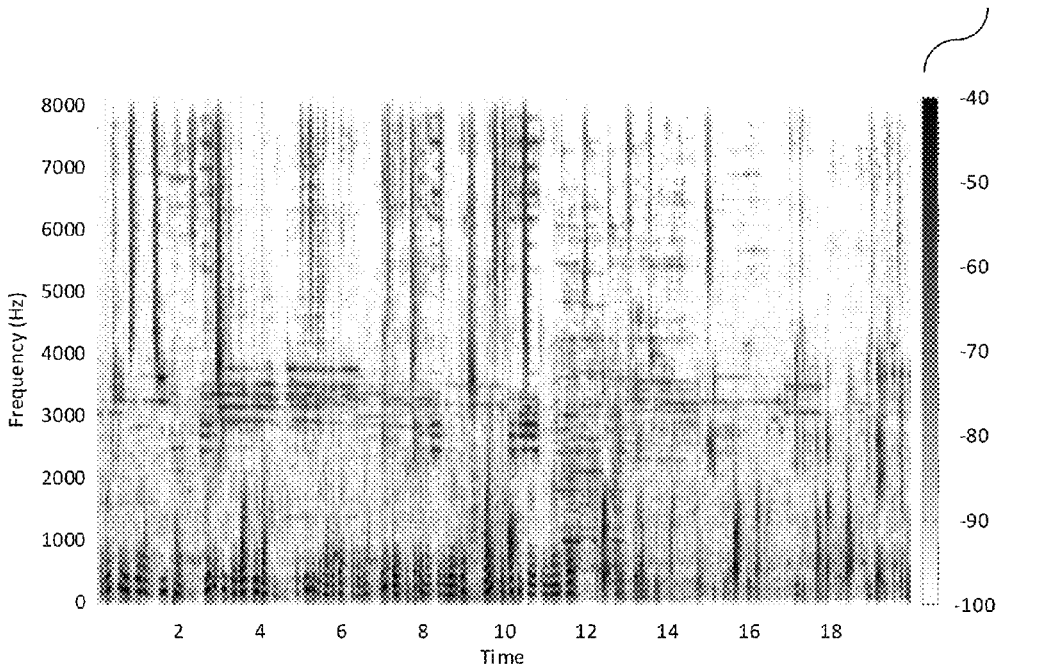

FIG. 2A and FIG. 2B illustrate the performance of a noise reduction system to enhance a noisy speech signal which is contaminated with traffic noise. This particular noise reduction system uses a MS-based noise estimation technique. This may demonstrate the insufficient tracking of traffic noise sources, which results in a high level of residual noise. In the example of a MS-based NR (noise reduction) system illustrated in FIG. 2A and FIG. 2B, in FIG. 2A, an illustration 200 illustrating an input noisy speech in traffic noise scenario is shown, and in FIG. 2B, an illustration 202 illustrating an output of the NR system is shown.

Figure 3:
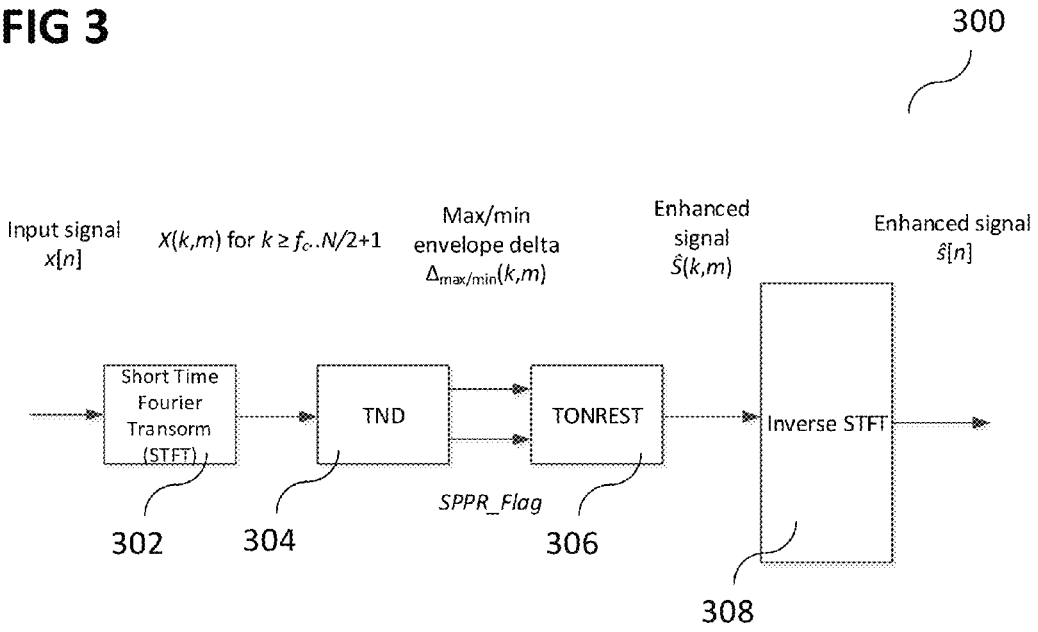
FIG. 3 shows a system diagram of a noise reduction device.

FIG. 3 shows a traffic noise reduction system 300. A model may be described as follows:

$$x[n]=s[n]+d[n], \tag{1}$$

where x[n] may be the noisy speech signal, s[n] may be the original noise-free speech, and d[n] may be the noise source which may be assumed to be independent of the speech. The Short Time Fourier Transform (STFT) of (1), which for example may be performed in 302, may be written as:

$$X(k,m)=S(k,m)+D(k,m) \quad (2)$$

for frequency bin k and time frame m. It will be understood that for the frequency bin k, either the frequency itself may be used or an index representing the frequency.

The TNR system 300 may first perform Traffic Noise Detection (TND, which may also be referred to as a noise detection circuit) in 304 to extract underlying signal characteristics which may be used to detect the presence of traffic noise. The max/min envelope delta, $\Delta_{max/min}(k,m)$, which may be referred to as a first indicator, and the Spectral Peak Profile Ratio, SPPR(m), which may be referred to as a second indicator, may be used in the Tonal Noise Reduction by Estimation (TONREST, 306, which may also be referred to as a noise reduction circuit) technique to attenuate the detected traffic noise components and to thus provide an enhanced signal $\hat{S}$ (k,m) in the frequency domain. The output enhanced signal $\hat{s}$ [n] may then be reconstructed using inverse STFT 308. The TND 304 and the TONREST 306 stages of the TNR system 300 from FIG. 3 will be described in more detail below.

Devices and methods may be provided which may reduce the level of noise in traffic, thereby improving the quality of voice conversations in mobile communication devices.

Devices and methods may be provided which may perform noise reduction on spectral components only associated with the traffic noise and may not impact any other type of encountered noises or speech. As a result, the devices and methods may not introduce speech distortion that is commonly introduced in noise reduction techniques.

The devices and methods may provide an automatic analysis of the signal, and thus may not require additional hardware or software for switching the technique on and off, as they may only operate on the traffic noise components when present.

Devices and methods may be provided which may be used together with an existing noise reduction system by applying them as a separate step and as such, the devices and methods may also be optimized and tuned separately.

The devices and methods may have a low complexity because of their modular architecture. The devices and methods may have both low computational requirements and low memory requirements. These may be important advantages for battery operated devices.

Moreover, many other acoustic enhancement techniques typically in a communication link may operate also in the frequency domain, for example echo cancelers. This may allow for computationally efficient implementations by combining the frequency to time transforms of various processing modules in the audio sub-system.

Devices and methods may be provided which may automatically analyze the scene to prepare for the detection of traffic noise.

The devices and methods may perform a first stage of detection to identify and extract features which may be associated with traffic noise sources.

The devices and methods may separate the speech signal from the traffic noise components.

Devices and methods may be provided which may determine a speech presence probability from these extracted features which may be used for accurate speech and noise power estimation.

The devices and methods may estimate the speech and traffic noise power.

The devices and methods may estimate the speech signal's spectral magnitude from spectral information surrounding the detected traffic noise components.

Devices and methods may be provided which may reduce the level of the traffic noise using the estimated speech signal magnitude. This may reduce the noisy speech spectral magnitude to levels associated with the underlying speech estimate.

This may result in a more comfortable listening experience by reducing the level of traffic noises without the speech distortion that is commonly introduced in noise reduction techniques.

In the following, a system integration of devices and methods will be described.

Figure 4:
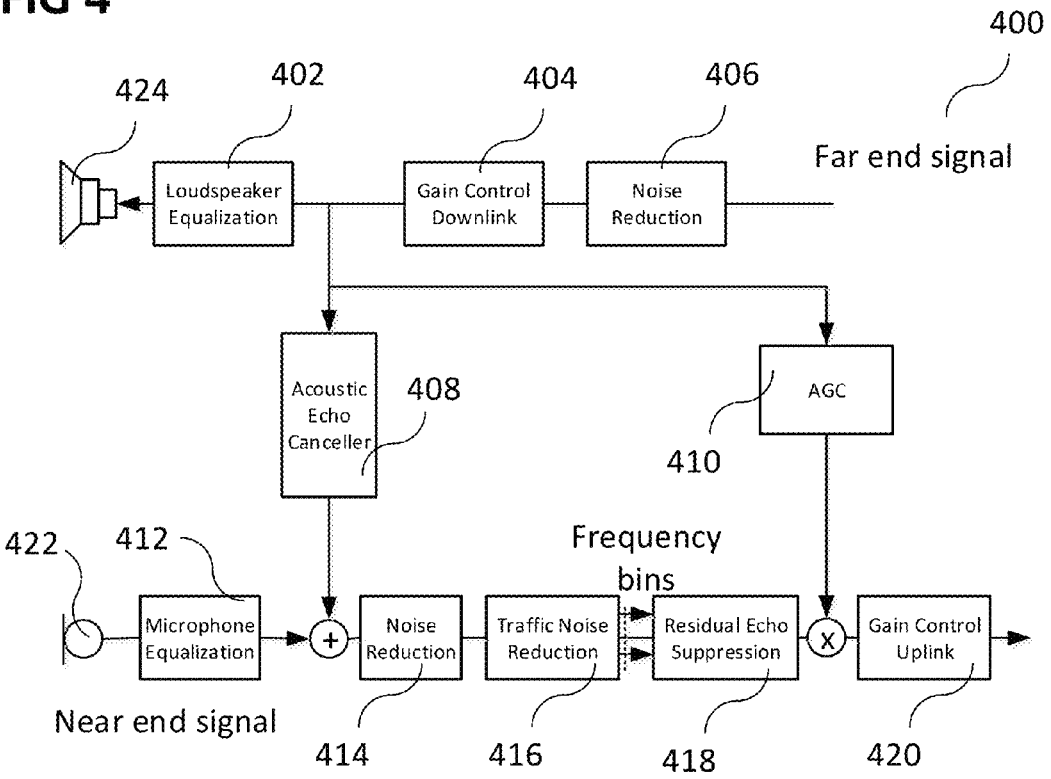
FIG. 4 shows how the noise reduction device may be integrated in a voice communication link.

FIG. 4 shows an audio processing system 400, which illustrates an integration of the TNR 416 in a voice communication link. The uplink signal from a microphone 422 (which may include the noisy speech), may be processed by a microphone equalization module 412 and a noise reduction module 414. The output may be input into the TNR system 416. For example, the TNR 416 may be combined with the frequency domain residual echo suppression module 418 (which may be provided as an integrated module of the residual echo suppression module 418 and an AGC 410, like will be described below), but if this module was not available, the TNR 416 may have its own frequency-to-time transform. The other processing elements on the downlink (for example the noise reduction module 406, the gain control downlink 404, and the loudspeaker equalization 402), and an acoustic echo canceller component 408 are shown for illustration purposes, but may not be involved into the processing of the traffic noise reduction 416. Furthermore, an AGC (automatic gain control) 410 and a gain control uplink 420 may be provided In the following, the TND system will be described.

The TNR system may attenuate noise components, while minimizing distortion to the desired speech signal. The TND system may extract characteristics of a noise components in the traffic noise which may then be used for performing detection and classification of the desired speech and noise components. The TND system may be particularly effective at detecting tonal noise components, such vehicular horn sounds. The TND system shown in FIG. 3 is illustrated in more detail in FIG. 5.

Figure 5:
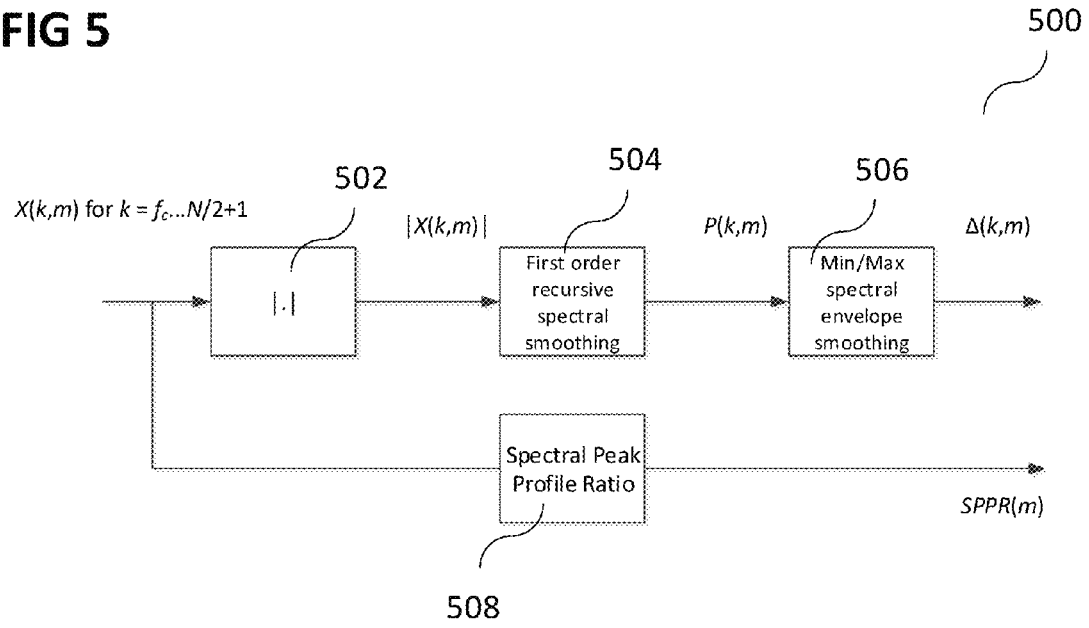
FIG. 5 shows a noise detection circuit.

FIG. 5 shows a TND system 500 used for extracting features utilized for the detection and classification of desired speech and traffic noise components. The TND system 500 may also be referred to as a noise detection circuit.

The top branch of FIG. 5 is first described as follows (in the bottom branch, a spectral peak profile ratio determination module 508 may be provided, which will be described in more detail later). Vehicular traffic horns sounds may occur at different frequencies depending on their source of origin. However, it was observed that the power levels of these sounds are either stationary for short time segments (signal dependent) or the power level decays with time. This characteristic may be not the same for speech signals, as the power level fluctuates at a faster rate (for example 4 to 6 syllables per second) than the vehicular horn noises. Therefore, in this branch of the TND system, the minimum and maximum power envelopes of the noisy signal are tracked in 506 and the magnitude of their difference may be used to classify either the desired speech or the target noise sources. The first iteration of this technique involves the smoothing of the noisy speech spectral components |X(k,m)|, which may be determined in 502. X(k,m) may denote the Fourier coefficient related to a k-th frequency (wherein k may be an number between $f_c$ (which may be a design parameter and may represent a cut-off frequency) and N/2+1) and an m-th point in time (in other words: the m-th time frame). The smoothing may form the smoothed noisy signal spectrum P(k,m) by first order recursive averaging in 504, for example according to the following formula:

$$P(k,m)=(1-\alpha)P(k,m-1)+\alpha|X(k,m)|, \tag{3}$$

where a may be the smoothing constant. The smoothing constant $\alpha$ may be calculated using:

$$\alpha=1/(\tau\times f_s), \tag{4}$$

where $\tau$ may be the specified time constant and $f_s$ may be the sampling frequency.

The two cases of increasing and decreasing power may be considered as described below to determine the smoothing constant to be used in (3) to obtain P(k,m):

For increasing power, i.e. X(k,m)>P(k,m−1), the smoothing factor may be set as follows, wherein $\alpha_{rise}$ may be a design variable (for example, $\alpha_{rise}=-1$), which may be called TNR_SpecSmoothRise:

Smoothing factor $\alpha=2^{\alpha_{rise}}$.

For decreasing power, i.e. X(k,m)<P(k,m−1), the smoothing factor may be set as follows, wherein $\alpha_{fall}$ may be a design variable (for example, $\alpha_{fall}=-1$), which may be called TNR_SpecSmoothFall:

Smoothing factor $\alpha=2^{\alpha_{fall}}$.

The minimum and maximum envelopes of P(k,m) may be tracked to determine the corresponding envelope signals $P_{max}$(k,m) and $P_{min}$(k,m). $P_{max}$(k,m) and $P_{min}$(k,m) may be initialized to P(k,m) for the first M frames (for example 200 ms to 300 ms initialization time duration). The maximum spectral envelope $P_{max}$(k,m) may be tracked and smoothed, such that it may be updated when the signal energy increases, and the signal envelope decays otherwise (for example for constant energy level or decrease in energy). The computation of $P_{max}$(k,m) may be performed as follows:

If $P(k,m) \le P_{max}(k,m-1)$ $$P_{max}(k,m) = (1-\beta)\,P_{max}(k,m-1) + \beta|\,P(k,m)\,|$$

else $$P_{max}(k,m) = P(k,m),$$

wherein a smoothing factor $\beta=2^{\beta_{fall}}$ may be used, wherein $\beta_{fall}$ may be a design variable (for example, $\beta_{fall}=-7$) and may also be referred to as TNR_EnvSmoothFall.

The minimum spectral envelope $P_{min}$(k,m) may be tracked and smoothed, such that it may be updated when the signal energy decreases, and the signal envelope may increase otherwise (for example for constant energy level or an increase in energy). The computation of $P_{min}$(k,m) may be performed as follows:

If $P(k,m) \ge P_{min}(k,m-1)$ $$P_{min}(k,m) = (1-\beta)\,P_{min}(k,m-1) + \beta|\,P(k,m)\,|$$

else $$P_{min}(k,m) = P(k,m),$$

wherein a smoothing factor $\beta=2^{\beta_{rise}}$ may be used, wherein $\beta_{rise}$ may be a design variable (for example, $\beta_{rise}=-7$) and may also be referred to as TNR_EnvSmoothRise.

A final stage of the TND may involve the computation of the difference between $P_{max}$(k,m) and $P_{min}$(k,m). This difference is denoted as Δ(k,m), which may also be referred to as bandwidth, and may be determined as follows:

$$\Delta(k,m)=P_{max}(k,m)-P_{min}(k,m), \tag{9}$$

where $P_{max}$(k,m) and $P_{min}$(k,m) may be given in dB in equation (9).

During traffic noise occurrences such as vehicular horn sounds, the second order statistics of these noises may either remain relatively stationary or may tend to decrease. From the above analysis of the TND technique, it may be seen that during noise instances which exhibit such behavior, the two spectral envelopes of $P_{max}$(k,m) and $P_{min}$(k,m) may converge resulting in a decrease in the value of Δ(k,m). Therefore, Δ(k,m) may be used in TONREST to classify the signal components as desired speech or noise, before performing attenuation. An example of the underlying process may be demonstrated using the spectrograms in FIG. 6A, FIG. 6B and FIG. 6C.

Figure 6A:
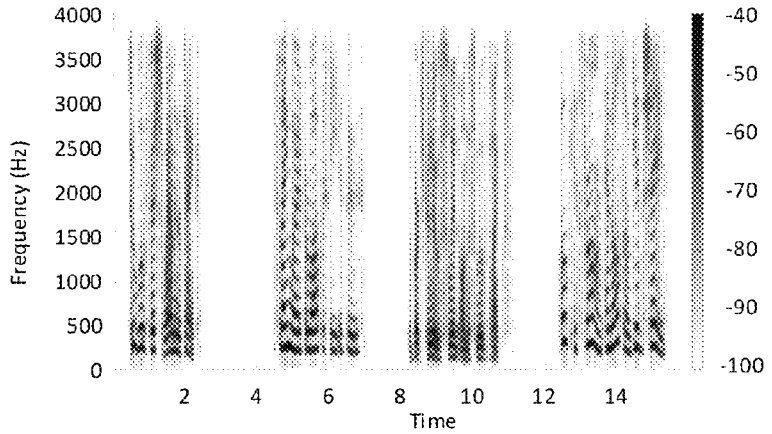
FIG. 6A, FIG. 6B, and FIG. 6C show diagrams illustrating the effect of a noise detection circuit.
Figure 6B:
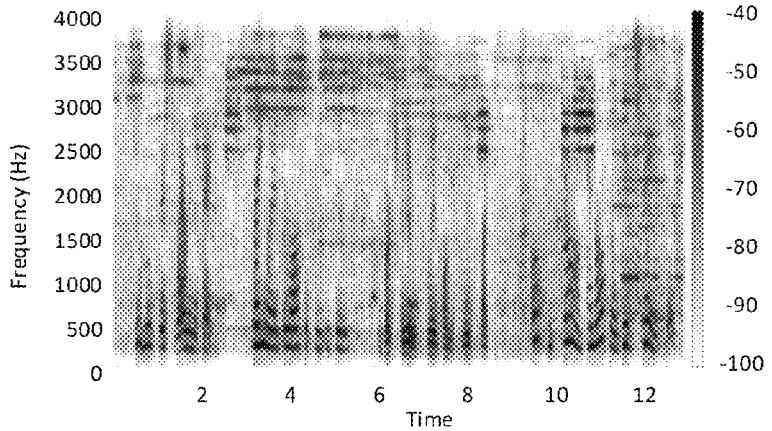
Figure 6C:
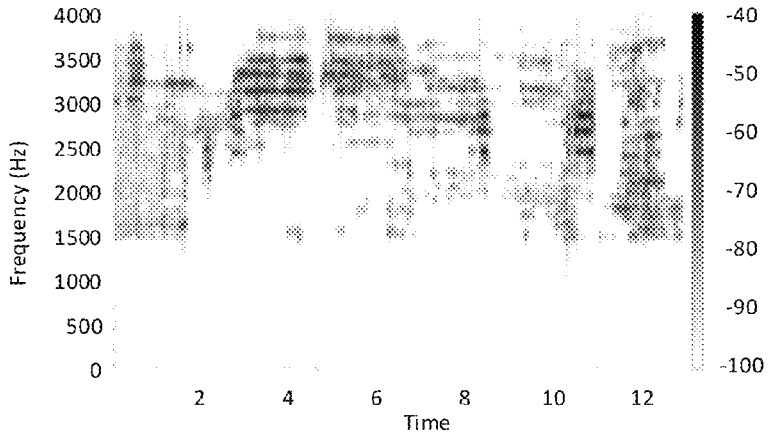

For the demonstration of the effect of the TND system at detecting traffic noise after deriving a binary mask from the extracted values of Δ(k,m), in FIG. 6A a diagram 600 illustrating a clean speech signal is shown, in FIG. 6B a diagram 602 illustrating a signal contaminated with traffic noise at 5 dB SNR is shown, and in FIG. 6C a diagram 604 illustrating a reconstructed traffic noise signal after applying a binary mask to the noisy signal is shown.

The noisy signal from FIG. 6B may be input to the TND system and the extracted values of Δ(k,m) may be compared against a fixed threshold r (wherein r may be a design variable, for example $\tau$=13) to derive a binary mask, which may be denoted by M. This mask may be applied to remove the speech components and retain the noise components such that:

$$M(i,m)=0 \text{ for } \Delta(i,m)>\tau,$$

and $$M(i,m)=1 \text{ for } \Delta(i,m)<\tau. \tag{10}$$

This mask M(i,m) may be applied to the input noisy signal to demonstrate the effectiveness of the TND system at detecting traffic noise components. The reconstructed signal containing the detected noise components is shown in FIG. 6C. It is to be noted that the value of $f_c$=1.5 kHz, therefore only those components above $f_c$ may be processed.

The time constants may be set to determine the smoothing factors used in the recursive averaging in the top branch of the TND system from FIG. 5. These may be set to allow minimum time for the convergence of $P_{max}$(k,m) and $P_{min}$(k,m) to avoid misdetections of speech as noise components. There may be instances of short, strong vehicular horn sounds. Therefore, an additional detection stage to determine the Spectral Peak Profile Ratio (SPPR, module 508 in FIG. 5; the SPPR may also be referred to as a second indicator) may be provided and may be included in the TND system for such cases as shown in the bottom branch of FIG. 5. Male and female speakers typically may have spectral profiles for speech where their pitch frequency exists below 500 Hz. As such, speech may have strong energy content below 1 kHz, the spectral characteristic of this low frequency region is most likely to be preserved in the presence of interfering noise, where larger spectral peaks occurs between 0 and 500 Hz than between 500 Hz and 1 kHz. However, this would not necessarily be observed in the presence of short, strong vehicular horn sounds. A measure of the distortion of the spectral profile may be defined as SPPR(m) below in equation (11) and may be used as a cue for the detection of traffic noise presence:

$$\mathrm{SPPR}(m)=\Phi_H(m)/\Phi_L(m), \tag{11}$$

where $\Phi_L(m)$ may be defined as the magnitude of the largest spectral peak between the frequencies 0 to $f_L$, where $f_L$, may assume a value of 500 Hz based on experimental analysis of long-term average speech spectrum. $\Phi_H(m)$ may be defined as the magnitude of the largest spectral peak between the frequencies $f_L+1$ to $f_H$, where $f_H$ may assume a value of 1 kHz.

In the following, the TONREST system will be described in more detail.

Figure 7:
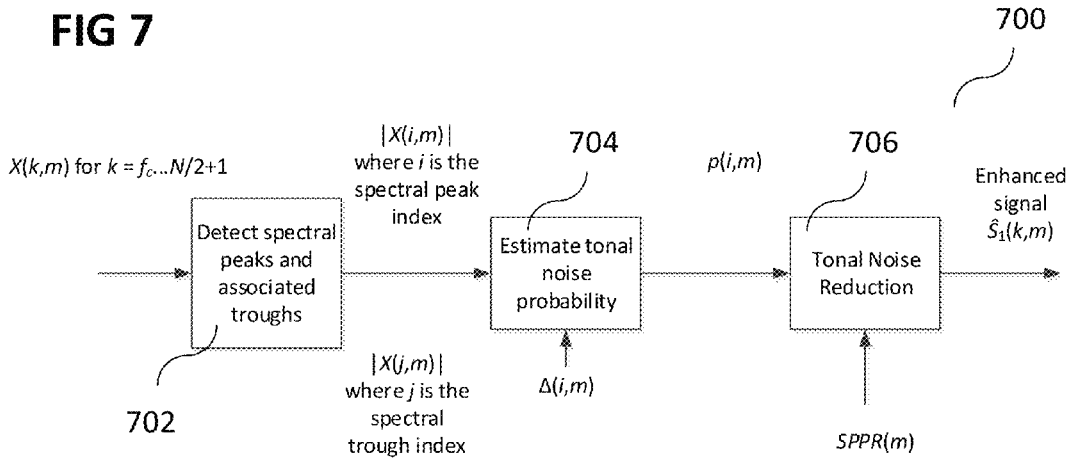
FIG. 7 shows a noise reduction circuit.

FIG. 7 shows a TONREST system 700 for traffic noise scenarios. The TONREST system 700 may also be referred to as a noise reduction circuit.

The TONREST system 700 may be designed to classify the input signal components of X(k,m) as either speech or noise and perform noise reduction. The targeted traffic noise components may have a tonal spectral structure and may occupy the entire signal spectrum. Therefore, the first stage 702 of TONREST as shown in FIG. 7 may involve the analysis of X(k,m) to detect the spectral peaks |X(i,m)|, where i may be the peak index. The corresponding spectral troughs |X(j,m)| may be detected (which may surround the peaks), where j may be the trough index in the signal spectrum.

Figure 8:
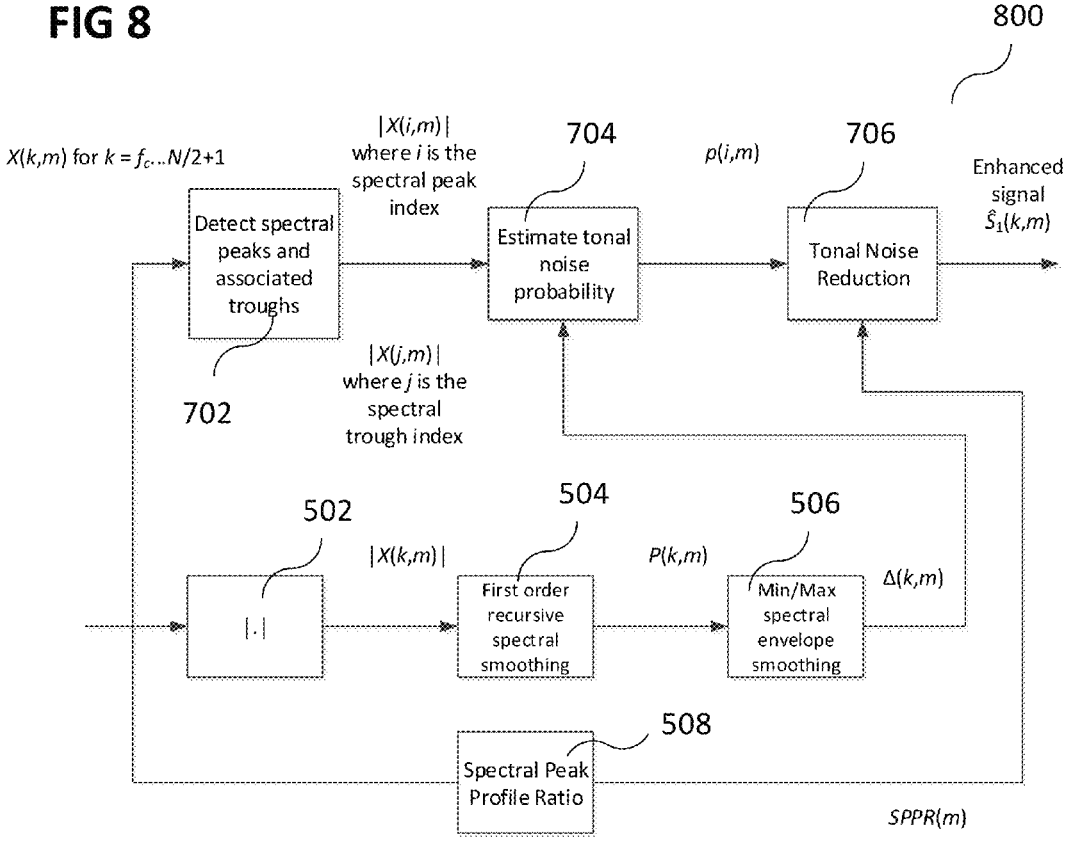
FIG. 8 shows a combination of a noise detection circuit and a noise reduction circuit.

The hypothesis $H_1$ may be used to denote the presence of tonal noise. The differences of the maximum and minimum envelopes Δ(i,m) may correspond to the identified spectral peaks and may then be used to estimate (in 704) the tonal noise probability $p(i,m)=p(H_1|\Delta(i,m))$ corresponding to the detected spectral peaks. The computed Δ(i,m) may yield p(i, m) as illustrated in FIG. 8 and defined as below:

$$\begin{aligned} p(i,m) &= 0 \text{ for } \Delta(i,m) > \tau_2, \\ &= (\tau_2 - \Delta(i,m))/(\tau_2 - \tau_1) \text{ for } \tau_1 \le \Delta(i,m) \le \tau_2, \\ &= 1 \text{ for } \Delta(i,m) < \tau_1, \end{aligned} \tag{12}$$

where the two thresholds $\tau_2$ and $\tau_1$ may be design variables and may be set to control the boundaries for the signal classification as speech or noise. These design variables may be dependent on the smoothing factors to be selected as described above.

Figure 9:
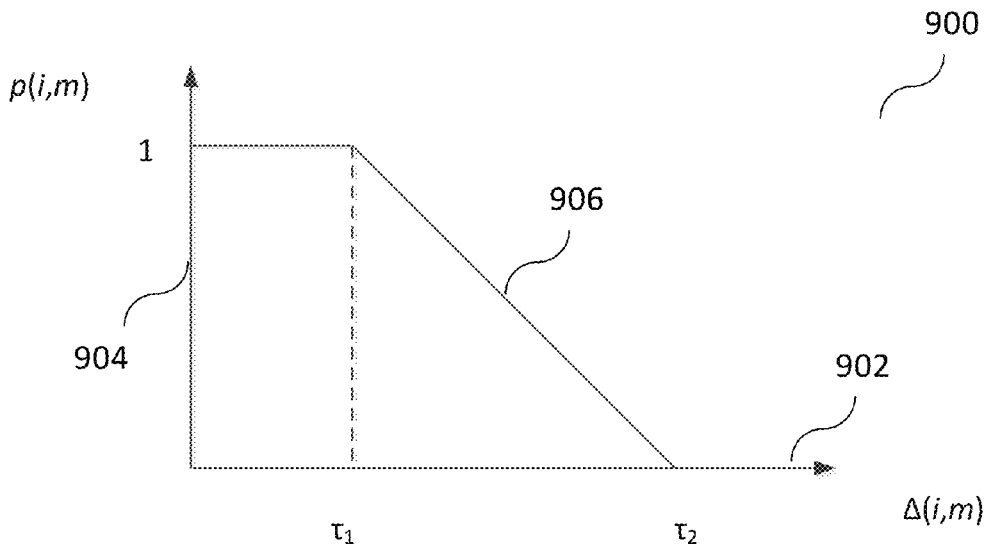
FIG. 9 and FIG. 10 show plots illustrating how an estimated tonal presence probability may be determined.

FIG. 9 shows a diagram 900 illustrating how the computed values of Δ(i,m) (on a horizontal axes 902) may yield the estimated tonal presence probability p(i, m) (on a vertical axes 904). The plot of equation (12) yields the curve 906.

An alternative mapping for the speech presence probability shown in FIG. 9 would be to use a non-linear mapping, such as a sigmoidal function, between $\tau_i$ and $\tau_2$.

Figure 10:
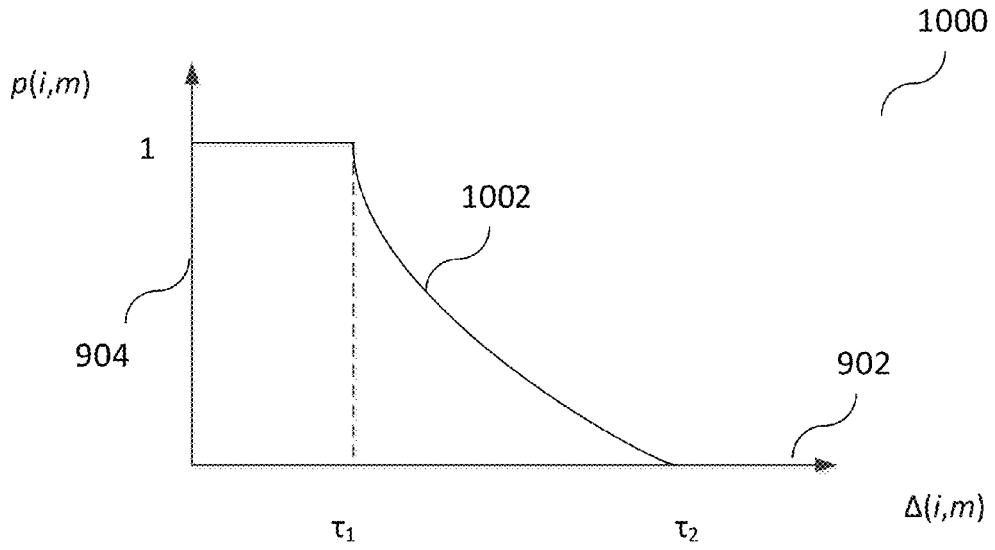

FIG. 10 shows an example of a further curve 1002.

In addition to the above described example for speech/noise classification, the SPPR(m), which may be computed according to equation (11) from the TND, may be compared against a threshold value η (which may be a design variable, for example η=6; as described above, this design variable may be a tuning parameter based on the system requirements for noise classification, as described above) to set a flag Attn_Flag(m) to 1 for speech classification and 0 for noise classification. As described above, this may be used to detect the presence of short, low SNR noise instances and Attn_Flag(m) may be obtained as follows:

$$\begin{aligned} \mathrm{Attn_Flag}(m) &= 0 \quad \text{for } SPPR(m) \le \eta, \\ &= 1 \quad \text{for } SPPR(m) > \eta. \end{aligned} \tag{13}$$

As this measure may be used for classification of special noise occurrences, the threshold η may be selected to be large enough to avoid misclassification of speech as noise.

A final stage of TONREST may in 706 involve the reduction of the detected tonal noises. For each spectral peak identified |X(i,m)|, a speech estimate $\lambda_S(i,m)$ may be obtained from the surrounding spectral troughs |X(j,m)|, which may be less affected by the tonal noise components. $\lambda_S(i,m)$ may be estimated as:

$$\lambda_S(i,m)=(|X(j,m)|+|X(j+1,m)|)/K \tag{14}$$

where a design variable K may be set to control the amount of attenuation applied to the noisy signal. Therefore, larger values of K may result in more signal attenuation. Unvoiced speech may have a relatively flat spectrum, and for these frequencies, a typical value of K=2 may be assumed. A noise estimate $\lambda_D$ (]j,j+1[, m) may hence be derived as:

$$\lambda_D(]j,j+1[,m)=|X(]j,j+1[,m)|-\lambda_S(i,m), \tag{15}$$

where ] j,j+1 [may denote the range of spectral troughs surrounding the examined peak i, excluding the end-points. The magnitude of the enhanced speech $\lambda_S$ (] j,j+1[, m) may then be recomputed by incorporating the estimated p(i,m) as:

$$\lambda_S(]j,j+1[,m)=|X(]j,j+1[,m)|-p(i,m)\lambda_D(]j,j+1[,m). \tag{16}$$

The speech estimate from equation (16) may be combined with the noise classification result Attn_Flag(m) and may be embedded in the following speech estimate:

$$|S(]j,j+1[,m)|=\zeta_{min}^{Attn_Flag(m)}\lambda_S(]j,j+1[,m)^{1-Attn_Flag(m)}, \tag{17}$$

wherein $\zeta_{min}$ may be a design variable.

This may also be formulated into a gain which may be applied to the noisy spectral components to obtain the enhanced signal. The speech estimate from (14) may be combined with the noise classification result Attn_Flag(m) and the tonal noise probability p(i,m) and may be embedded in the following TNR gain function G (equation (18)), which may then be applied to this equation to obtain the gain for those frequency bins ] j,j+1 [:

$$G(]j,j+1[,m)=((\zeta_{min})^{Attn_Flag(m)}(1-p(i,m)(1-\lambda_S(i,m)))^{1-Attn_Flag(m)})/|X(]j,j+1[,m)| \tag{18}$$

In the following, a cut-off frequency consideration will be described. Voiced speech components may have a harmonic structure which may be misclassified as the traffic noise components. Therefore, the lower cut-off frequency for operation of TONREST may be given by $f_c$.

FIG. 8 shows a combined system of the noise detection circuit shown in FIG. 5 and the noise reduction circuit shown in FIG. 7. The same reference signs may be used for similar or equivalent portions of the system.

The performance of the TNR technique for noise reduction and speech enhancement may be tested on speech utterances. The clean speech signals may be processed using tools using the MSIN (mobile station in) filter and the speech level may be set to −26 dB SPL (sound pressure level). The speech signals may be corrupted with traffic noise which may be dominated by vehicular horn sounds and processed using the TNR system illustrated in FIG. 3. A sampling frequency of 8 kHz may be used. The signal may be split up into frames of length 20 ms.

Figure 11A:
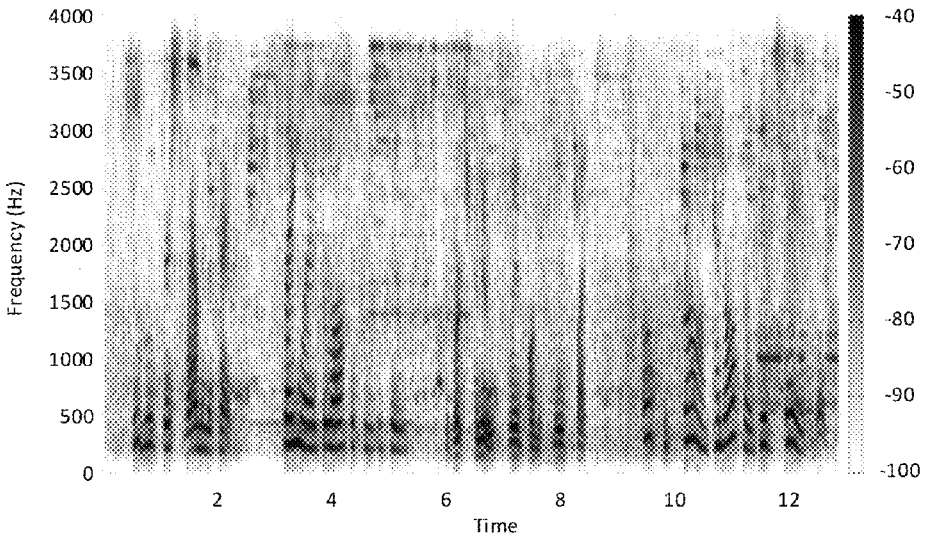
FIG. 11A and FIG. 11B shows effects of different parameters for a noise reduction device.
Figure 11B:
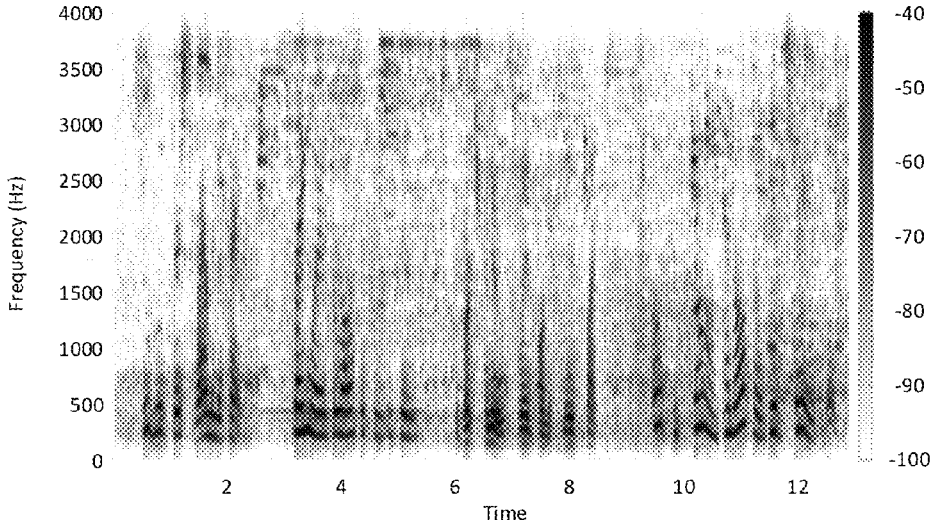

FIG. 11A and FIG. 11B show a comparison of the effects of the TNR system on the noisy speech from FIG. 6B. FIG. 11A shows an illustration 1100 illustrating enhanced speech using the previously given TNR parameters and $f_c$=1500 Hz and K=2. FIG. 11B shows an illustration 1102 of enhanced speech with the modification of the following two parameters $f_c$=800 Hz and K=100.

In a first assessment, the noisy speech signal presented in FIG. 6B may be processed using TNR. The enhanced signal is shown in FIG. 11A. The noisy signal from FIG. 6B was then processed again with the same parameters except with $f_c$=800 Hz and K=100. These changes were done to illustrate the effect of performing TNR on the lower frequencies of the noisy signal in addition to the application of more noise attenuation, by increasing the value of K. The results of this simulation are shown in FIG. 11B. These results demonstrate the effectiveness of TNR at attenuating the tonal components present in traffic noise, while preserving the underlying speech content to minimize speech distortion.

In order to assess the relative performance of the TNR system for speech enhancement, the objective measures of segmental SNR (segSNR, segmental signal to noise ratio), Perceptual Evaluation of Speech Quality (PESQ) and P8622 are used. These measures may be recorded to observe the amount of speech distortion introduced to clean speech signals which are processed using the TNR system. Both of the above simulation set-ups may be used with the standard TNR parameters described in the text (with $f_c$=1500 Hz and K=2 as in FIG. 11A) and also with the TNR parameters which may perform more noise attenuation (i.e. setting $f_c$=800 Hz and K=100, as in FIG. 11B). The results in Table 1 show that TNR may be effective at preserving speech quality, with slightly more distortion being introduced when the parameters are set for more noise reduction and lower cut-off frequency.

TABLE 1

Effect of the TNR system on clean speech signals using objective measures to evaluate level of speech distortion on the processed signal

| Input signal | PESQ | P8622 | SegSNR (dB) |
|---|---|---|---|
| Clean speech (standard TNR) | 4.4 | 4.5 | 41.2 |
| Clean speech ($f_c$ = 800 Hz; K = 100) | 4.2 | 4.3 | 35.7 |

Figure 12:
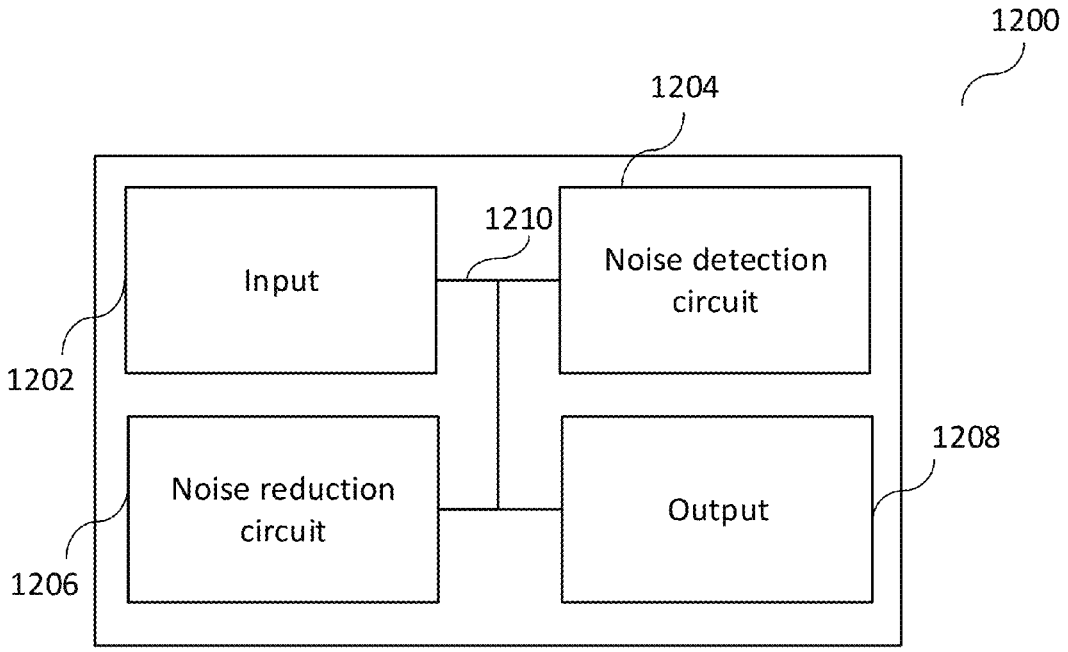
FIG. 12 shows a noise reduction device with a noise detection circuit and a noise reduction circuit.

FIG. 12 shows a noise reduction device 1200. The noise reduction device 1200 may include an input 1202 configured to receive an input signal. The input signal may include or may be a representation in a frequency domain of an audio signal. The representation may include or may be a plurality of time frames and a plurality of coefficients for each time frame. The noise reduction device 1200 may further include a noise detection circuit 1204 configured to determine a first indicator. The first indicator may be indicative of a bandwidth of a coefficient over at least two time frames. The noise reduction device 1200 may further include a noise reduction circuit 1206 configured to reduce, based on the first indicator, a noise component in the audio signal. The noise reduction device 1200 may further include an output 1208 configured to output an output signal. The output signal may include or may be a representation in the frequency domain of the audio signal with the reduced noise component. The input 1202, the noise detection circuit 1204, the noise reduction circuit 1206, and the output 1208 may be coupled with each other, for example via a connection 1210, for example an optical connection or an electrical connection, such as for example a cable or a computer bus or via any other suitable electrical connection to exchange electrical signals.

It will be understood that "indicative of" does not necessarily mean to give the precise value, but a qualitative information on the size of a value.

The noise detection circuit 1204 may further determine a second indicator (which may for example be the SPPR as described above). The second indicator may represent a ratio between a frequency component of the audio signal below a pre-determined threshold frequency and a frequency component of the audio signal above the pre-determined threshold frequency. The noise reduction circuit 1206 may reduce, based on the first indicator and the second indicator, the noise component in the audio signal.

The audio signal may include or may be a noise component and a speech component.

The noise detection circuit 1204 may determine the first indicator based on a difference between a smoothed maximum value of a coefficient over at least two frames and a smoothed minimum value of a coefficient over at least to frames.

The bandwidth of a coefficient over at least two time frames may include or may be a bandwidth of a coefficient corresponding to a pre-determined frequency at a first time frame and a coefficient corresponding to the pre-determined frequency at a second time frame.

The frequency component of the audio signal below a pre-determined threshold frequency may include or may be a spectral peak below the pre-determined threshold frequency.

The frequency component of the audio signal above a pre-determined threshold frequency may include or may be a large spectral peak between the pre-determined threshold frequency and a further pre-determined threshold frequency.

The noise reduction circuit 1206 may determine a tonal noise probability based on the first indicator.

The audio signal may include or may be a speech component and a noise component.

The noise reduction circuit 1206 may determine a flag indicating whether to classify the audio signal to a speech class or to a noise class based on the second indicator.

The noise reduction circuit 1206 may determine a spectral peak based on the input signal.

The noise reduction circuit 1206 may determine a speech estimate based on the determined spectral peak and a plurality of surrounding spectral troughs.

The noise reduction circuit 1206 may determine a noise estimate based on the speech estimate and at least one spatial trough surrounding the spectral peak.

The noise reduction circuit 1206 may determine an enhanced speed signal based on the tonal noise probability and the noise estimate.

The noise reduction circuit 1206 may determine an audio signal with the reduced noise component based on the flag and the speech estimate.

Figure 13:
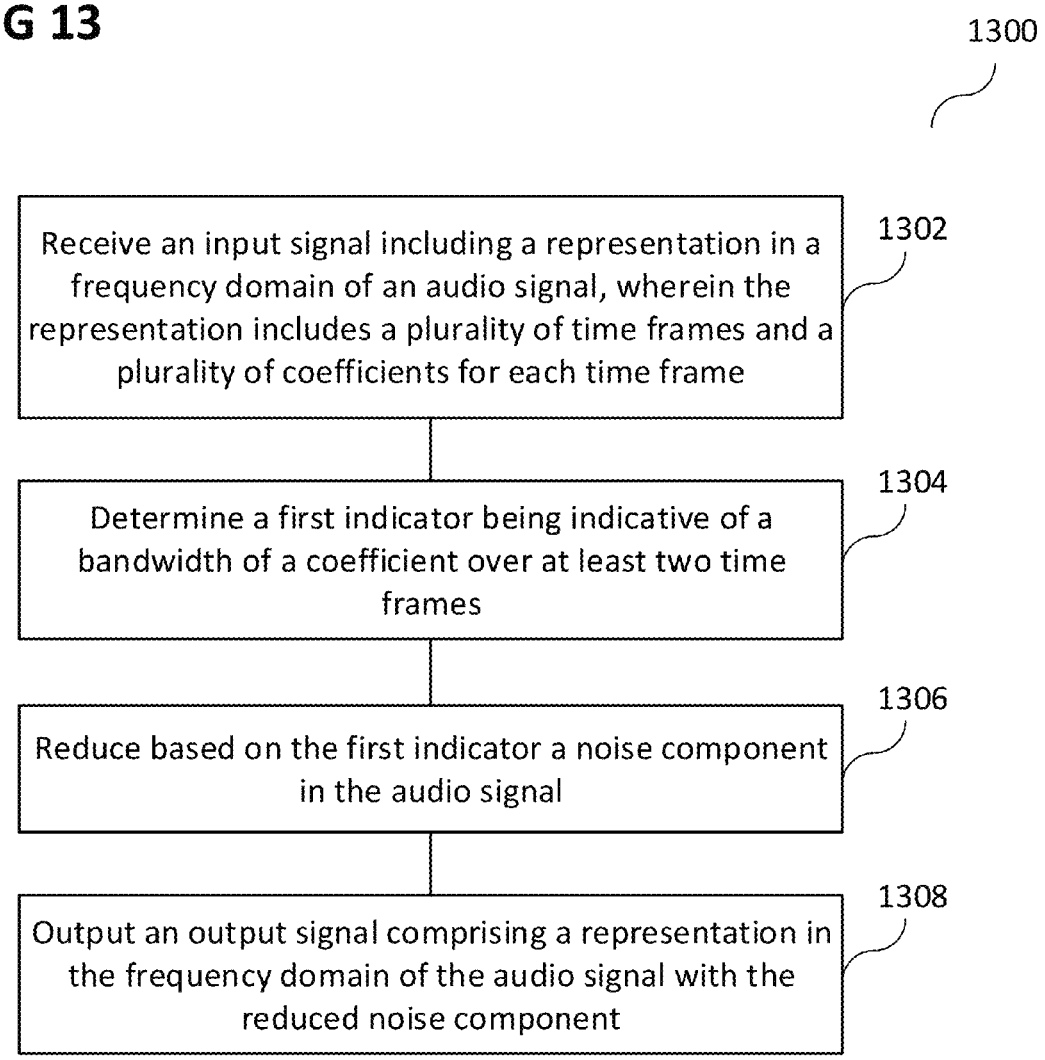
FIG. 13 shows a flow diagram illustrating a method for controlling the noise reduction device of FIG. 12.

FIG. 13 shows a flow diagram 1300 illustrating a noise reduction method, for example carried out by a noise reduction device. In 1302, an input of the noise reduction device may receive an input signal. The input signal may include or may be a representation in a frequency domain of an audio signal. The representation may include or may be a plurality of time frames and a plurality of coefficients for each time frame. In 1304, a noise detection circuit of the noise reduction device may determine a first indicator being indicative of a bandwidth of a coefficient over at least two time frames. In 1306, a noise reduction circuit of the noise reduction device may, based on the first indicator, reduce a noise component in the audio signal. In 1308, an output of the noise reduction device may output an output signal. The output signal may include or may be a representation in the frequency domain of the audio signal with the reduced noise component.

It will be understood that "indicative of" does not necessarily mean to give the precise value, but a qualitative information on the size of a value.

The noise detection circuit of the noise reduction device may further determine a second indicator representing a ratio between a frequency component of the audio signal below a pre-determined threshold frequency and a frequency component of the audio signal above the pre-determined threshold frequency. The noise reduction circuit of the noise reduction device may, based on the first indicator and the second indicator, reduce a noise component in the audio signal.

The audio signal may include or may be a noise component and a speech component.

The noise reduction method may further include determining the first indicator based on a difference between a smoothed maximum value of a coefficient over at least two frames and a smoothed minimum value of a coefficient over at least to frames.

The bandwidth of a coefficient over at least two time frames may include or may be a bandwidth of a coefficient corresponding to a pre-determined frequency at a first time frame and a coefficient corresponding to the pre-determined frequency at a second time frame.

The frequency component of the audio signal below a pre-determined threshold frequency may include or may be a spectral peak below the pre-determined threshold frequency.

The frequency component of the audio signal above a pre-determined threshold frequency may include or may be a large spectral peak between the pre-determined threshold frequency and a further pre-determined threshold frequency.

The noise reduction method may further include determining a tonal noise probability based on the first indicator.

The audio signal may include or may be a speech component and a noise component.

The noise reduction method may further include determining a flag indicating whether to classify the audio signal to a speech class or to a noise class based on the second indicator.

The noise reduction method may further include determining a spectral peak based on the input signal.

The noise reduction method may further include determining a speech estimate based on the determined spectral peak and a plurality of surrounding spectral troughs.

The noise reduction method may further include determining a noise estimate based on the speech estimate and at least one spatial trough surrounding the spectral peak.

The noise reduction method may further include determining an enhanced speed signal based on the tonal noise probability and the noise estimate.

The noise reduction method may further include determining an audio signal with the reduced noise component based on the flag and the speech estimate.

Figure 14:
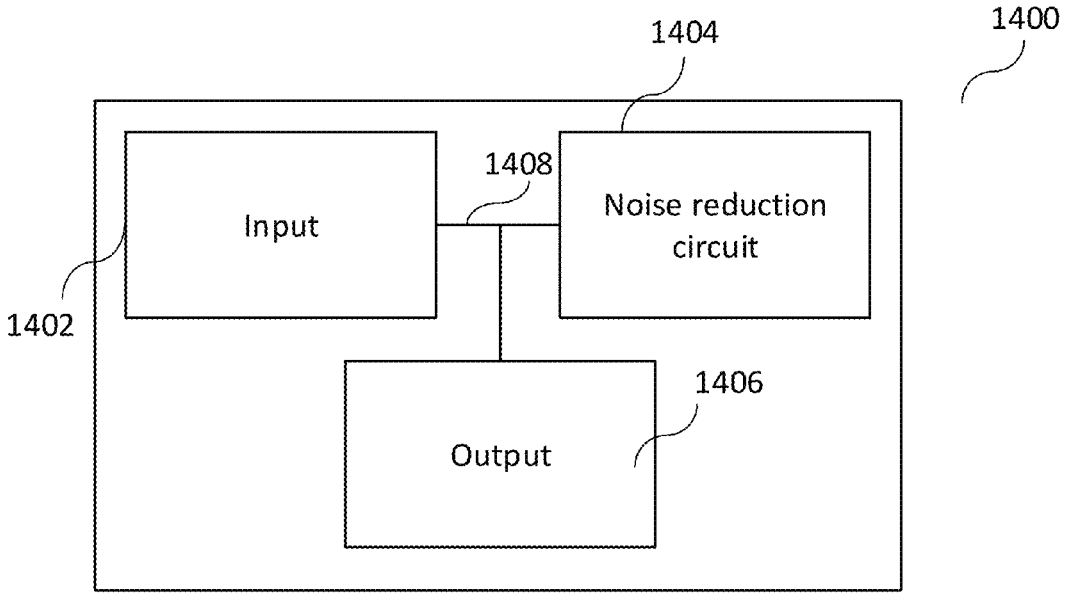
FIG. 14 shows a noise reduction device with a noise reduction circuit.

FIG. 14 shows a noise reduction device 1400. The noise reduction device 1400 may include an input configured to receive an input signal. The input signal may include or may be representation in a frequency domain of an audio signal. The representation may include or may be a plurality of time frames and a plurality of coefficients for each time frame. The noise reduction device 1400 may further include a noise reduction circuit 1404 configured to reduce a noise component in the audio signal based on a first indicator. The first indicator may be indicative of a bandwidth of a coefficient over at least two time frames. The noise reduction device 1400 may further include an output 1406 configured to output an output signal. The output signal may include or may be a representation in the frequency domain of the audio signal with the reduced noise component. The input 1402, the noise reduction circuit 1404, and the output 1406 may be coupled with each other, for example via a connection 1408, for example an optical connection or an electrical connection, such as for example a cable or a computer bus or via any other suitable electrical connection to exchange electrical signals.

It will be understood that "indicative of" does not necessarily mean to give the precise value, but a qualitative information on the size of a value.

The noise reduction circuit 1404 may reduce the noise component in the audio signal based on the first indicator and based on a second indicator. The second indicator may represent a ratio between a frequency component of the audio signal below a pre-determined threshold frequency and a frequency component of the audio signal above the pre-determined threshold frequency.

The audio signal may include or may be a noise component and a speech component.

The bandwidth of a coefficient over at least two time frames may include or may be a bandwidth of a coefficient corresponding to a pre-determined frequency at a first time frame and a coefficient corresponding to the pre-determined frequency at a second time frame.

Figure 15:
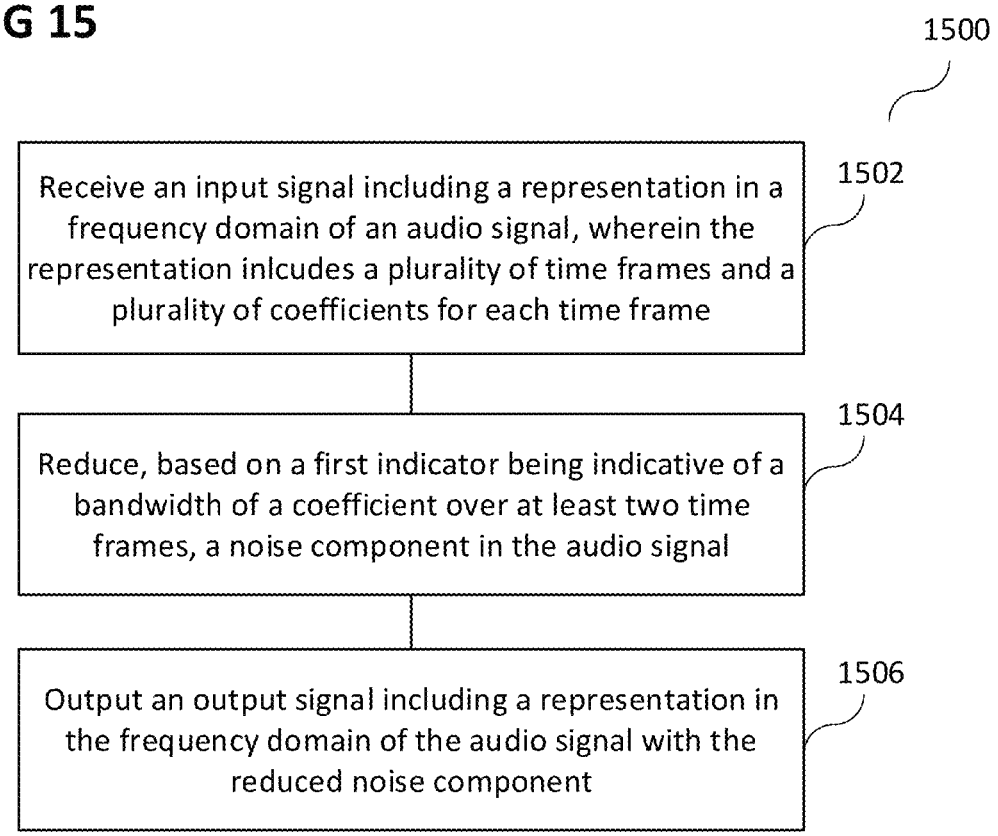
FIG. 15 shows a flow diagram illustrating a method for controlling the noise reduction device of FIG. 14.

FIG. 15 shows a flow diagram 1500 illustrating a noise reduction method, for example carried out by a noise reduction device. In 1502, an input of the noise reduction device may receive an input signal. The input signal may include or may be a representation in a frequency domain of an audio signal. The representation may include or may be a plurality of time frames and a plurality of coefficients for each time frame. In 1504, a noise reduction circuit of the noise reduction device may reduce a noise component in the audio signal, based on a first indicator. The first indicator may be indicative of a bandwidth of a coefficient over at least two time frames. In 1506, an output of the noise reduction device may output an output signal. The output signal may include or may be a representation in the frequency domain of the audio signal with the reduced noise component.

It will be understood that "indicative of" does not necessarily mean to give the precise value, but a qualitative information on the size of a value.

The noise reduction circuit of the noise reduction device may reduce the noise component in the audio signal, based on the first indicator and based on a second indicator. The second indicator may represent a ratio between a frequency component of the audio signal below a pre-determined threshold frequency and a frequency component of the audio signal above the pre-determined threshold frequency.

The audio signal may include or may be a noise component and a speech component.

The bandwidth of a coefficient over at least two time frames may include or may be a bandwidth of a coefficient corresponding to a pre-determined frequency at a first time frame and a coefficient corresponding to the pre-determined frequency at a second time frame.

While the invention has been particularly shown and described with reference to specific aspects of this disclosure, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A noise reduction device configured for use in a radio communication device comprising:

an input configured to receive an audio signal comprising a representation having a plurality of power envelopes; wherein the audio signal consists of a noise-free speech component and a tonal noise component;

a tonal noise detection circuit configured to estimate a tonal noise probability based on a first indicator and a second indicator; wherein the first indicator represents an amount of the tonal noise component in the audio signal based on a magnitude of difference between a maximum power envelope and a minimum power envelope; wherein the second indicator represents a ratio of the largest spectral peak within a frequency range between 501 Hz to 1 KHz as compared to the largest spectral peak within a frequency range between 0 Hz to 500 Hz;

memory for storing the first indicator and a predetermined range for the first indicator and for storing the second indicator and a predetermined threshold for the second indicator;

a noise reduction circuit configured to reduce the tonal noise component within the audio signal when the first indicator is outside the predetermined range for the first indicator and when the second indicator is above the predetermined threshold; and an output configured as an audio signal comprising a reduced amount of the tonal noise component.

2. The noise reduction device of claim 1, wherein the noise detection circuit is further configured to generate a second indicator representing a ratio of the largest spectral peak within a first frequency range as compared to the largest spectral peak within a second frequency range;

the memory is further configured to store the second indicator and a predetermined range for the second indicator;

the noise reduction circuit is further configured to compare the second indicator to a predetermined range for the second indicator, and wherein the noise reduction circuit is further configured to reduce the tonal noise component when the first indicator is outside the predetermined range for the first indicator and/or when the second indicator is outside the predetermined range for the second indicator.

3. The noise reduction device of claim 1, wherein the maximum power envelope is a smoothed maximum power envelope, and wherein the minimum power envelope is a smoothed minimum power envelope.

4. The noise reduction device of claim 1, wherein the tonal noise probability is estimated in a non-linear manner.

5. The noise reduction device of claim 1, wherein the radio communication device is a mobile telephone, a personal digital assistant, a mobile computer, and combinations thereof.

6. A radio communication device implemented method for decreasing tonal noise in an audio signal, wherein the method comprises:

receiving an audio signal comprising a plurality of power envelopes; wherein the audio signal consists of a noise-free speech component and a tonal noise component;

estimating a tonal noise probability based on a first indicator and a second indicator with a tonal noise detection circuit; wherein the first indicator represents an amount of the tonal noise component in the audio signal based on a magnitude of difference between a maximum power envelope and a minimum power envelope; and wherein the second indicator represents a ratio of the largest spectral peak within a frequency range between 501 Hz to 1 KHz as compared to the largest spectral peak within a frequency range between 0 Hz to 500 Hz;

storing the first indicator and a predetermined range for the first indicator in a memory location and storing the second indicator and a predetermined threshold for the second indicator;

comparing the first indicator to the predetermined range for the first indicator and comparing the second indicator to the predetermined threshold;

reducing the tonal noise component within the audio signal when the first indicator is outside the predetermined range for the first indicator and when the second indicator is above the predetermined threshold; and outputting an audio signal comprising a reduced amount of the tonal noise component.

7. The radio communication device implemented method of claim 6, wherein the noise detection circuit is further configured to generate a second indicator representing a ratio of the largest spectral peak within a first frequency range as compared to the largest spectral peak within a second frequency range;

memory is further configured to store the second indicator and a predetermined range for the second indicator;

the noise reduction circuit is further configured to compare the second indicator to a predetermined range for the second indicator, and wherein the noise reduction circuit is further configured to reduce the tonal noise component when the first indicator is outside the predetermined range for the first indicator and/or when the second indicator is outside the predetermined range for the second indicator.

8. The radio communication device implemented method of claim 6, wherein the maximum power envelope is a smoothed maximum power envelope, and wherein the minimum power envelope is a smoothed minimum power envelope.

9. The radio communication device implemented method of claim 6, wherein the tonal noise probability is estimated in a non-linear manner.

10. The radio communication device implemented method of claim 6, wherein the radio communication device is a mobile telephone, a personal digital assistant, a mobile computer, and combinations thereof.

11. A noise reduction device for use in a radio communication device selected from the group consisting of a mobile telephone, a personal digital assistant, a mobile computer, and combinations thereof; wherein the noise reduction device comprises:

an input configured to receive an audio signal comprising a representation having a plurality of power envelopes; wherein the audio signal consists of a noise-free speech component and a tonal noise component;

a tonal noise detection circuit configured to estimate a tonal noise probability based on a first indicator and a second indicator; wherein the first indicator represents an amount of the tonal noise component in the audio signal based on a magnitude of difference between a maximum power envelope and a minimum power envelope; and wherein the second indicator represents a ratio of the largest spectral peak within a frequency range between 501 Hz to 1 KHz to as compared to the largest spectral peak within a frequency range between 0 Hz to 500 Hz;

memory for storing the first indicator, a predetermined range for the first indicator, and storing the second indicator and a predetermined threshold for the second indicator;

a noise reduction circuit configured to reduce the tonal noise component within the audio signal when the first indicator is outside the predetermined range for the first indicator and when the second indicator is above the predetermined threshold; and an output configured as an audio signal comprising a reduced amount of the tonal noise component.

12. The radio communication device of claim 11, wherein the maximum power envelope is a smoothed maximum power envelope, and wherein the minimum power envelope is a smoothed minimum power envelope.

13. The radio communication device of claim 11, wherein the tonal noise probability is estimated in a non-linear manner.

* * * * *